US012044500B2

(12) United States Patent
Poston et al.

(10) Patent No.: US 12,044,500 B2
(45) Date of Patent: Jul. 23, 2024

(54) AMMUNITION MAGAZINE LOADER

(71) Applicants: Jeffrey K. Poston, Florence, KY (US); Jerry K. Poston, Loveland, OH (US)

(72) Inventors: Jeffrey K. Poston, Florence, KY (US); Jerry K. Poston, Loveland, OH (US)

( * ) Notice: Subject to any disclaimer, the term of this patent is extended or adjusted under 35 U.S.C. 154(b) by 0 days.

(21) Appl. No.: 17/670,961

(22) Filed: Feb. 14, 2022

(65) Prior Publication Data

US 2022/0268542 A1 Aug. 25, 2022

Related U.S. Application Data

(60) Provisional application No. 63/151,220, filed on Feb. 19, 2021.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
See application file for complete search history.

(56) References Cited

U.S. PATENT DOCUMENTS 4,304,062 A * 12/1981 Pepe ..... F41A 9/83 42/87
4,689,909 A * 9/1987 Howard ..... F41A 9/83 42/87
4,706,402 A * 11/1987 Csongor ..... F41A 9/83 42/87
4,862,621 A * 9/1989 Kearney ..... F41A 9/83 42/87
6,678,985 B2 * 1/2004 Pikula ..... F41A 9/83 42/87
7,503,138 B2 * 3/2009 Tal ..... F41A 9/83 42/87
7,637,048 B2 * 12/2009 Tal ..... F41A 9/83 42/87
10,001,331 B2 * 6/2018 Couie ..... F41A 9/83
10,060,692 B2 * 8/2018 Couie ..... F41A 9/67
10,415,911 B2 * 9/2019 Couie ..... F41A 9/67
10,422,599 B2 * 9/2019 Fischer ..... F41A 9/83
10,845,144 B1 * 11/2020 Witecha ..... F41A 9/84
10,976,121 B2 * 4/2021 Draper ..... F41A 9/83
11,187,480 B1 * 11/2021 Anderson ..... F41A 9/83
11,248,865 B2 * 2/2022 Rosenblum ..... F41A 9/38
11,313,634 B1 * 4/2022 Newby ..... F41A 9/83
11,448,475 B1 * 9/2022 Laycock ..... F41A 9/83
11,506,462 B1 * 11/2022 Newby ..... F41A 9/83
2003/0093936 A1 * 5/2003 Pikula ..... F41A 9/83 42/87

(Continued)

*Primary Examiner* — Michelle Clement
(74) *Attorney, Agent, or Firm* — Jenei LLC

(57) ABSTRACT

An ammunition magazine loader is disclosed herein. The ammunition magazine loader comprises a loader body defining a guide channel. The loader body is configured to facilitate an introduction of a magazine into the guide channel and allow a linear movement of the magazine back and forth along a longitudinal axis of the loader body within the guide channel. The guide channel is configured to facilitate the placement of a round to be loaded into the magazine therein and facilitate the loading of the round in the loader via the linear movement of the magazine in the guide channel.

16 Claims, 20 Drawing Sheets

(56) References Cited

U.S. PATENT DOCUMENTS

| | | | | |
|---|---|---|---|---|
| 2007/0017140 | A1* | 1/2007 | Pikielny | F41A 9/83 42/87 |
| 2009/0044440 | A1* | 2/2009 | Tal | F41A 9/84 42/87 |
| 2009/0288326 | A1* | 11/2009 | Twardy | F41A 9/83 42/87 |
| 2013/0192117 | A1 | 8/2013 | Meinel | |
| 2015/0316341 | A1 | 11/2015 | Aguilar | |
| 2015/0377573 | A1* | 12/2015 | Niccum | F41A 9/83 42/87 |
| 2017/0115082 | A1 | 4/2017 | Butler | |
| 2017/0176121 | A1 | 6/2017 | Plate | |
| 2017/0067707 | A1 | 12/2017 | Zivic et al. | |
| 2018/0066907 | A1 | 3/2018 | Hefer et al. | |
| 2018/0202735 | A1* | 7/2018 | Draper | F41A 9/82 |
| 2018/0216905 | A1 | 8/2018 | Lamarche | |
| 2019/0107350 | A1 | 4/2019 | Hefer et al. | |
| 2019/0154376 | A1 | 5/2019 | Cottrell et al. | |
| 2019/0310041 | A1 | 10/2019 | Plate | |
| 2020/0096273 | A9 | 3/2020 | Plate | |
| 2020/0124367 | A1 | 4/2020 | Fischer | |
| 2020/0378705 | A1 | 12/2020 | Hefer et al. | |
| 2022/0268542 | A1* | 8/2022 | Poston | F41A 9/83 |
| 2022/0373280 | A1* | 11/2022 | Couie | F41A 9/83 |
| 2022/0404110 | A1* | 12/2022 | Baker | F41A 9/83 |

* cited by examiner

AMMUNITION MAGAZINE LOADER

CROSS-REFERENCE TO RELATED APPLICATIONS

The present application claims the benefit of U.S. Provisional Application Ser. No. 63/151,220 entitled "AMMUNITION MAGAZINE LOADER" filed Feb. 19, 2021, which is hereby expressly incorporated by reference herein to form part of the present disclosure.

TECHNICAL FIELD

The present disclosure relates generally to ammunition magazines, and more particularly, to a storage and loader devices for loading ammunition rounds in the ammunition magazine.

BACKGROUND

Guns, such as pistols and handguns, are designed to receive ammunition magazines. The ammunition magazine carries a number of ammunition rounds or bullets. The purpose of the ammunition magazine is to store the ammunition rounds within the gun and feeding the ammunition rounds into the firing chamber of the gun. In handguns, the ammunition magazines may be configured to feed more than one ammunition rounds into the firing chamber.

A typical basic construction of an ammunition magazine includes a magazine body with a loading end and a closed end with a biasing element disposed between the loading end and the closed end. The ammunition rounds are to be loaded sequentially within the magazine body against the compression force exerted by the biasing element. Once loaded in the ammunition magazine, the ammunition rounds are spring loaded toward the loading end for subsequent ejection therefrom when the ammunition magazine is loaded in a gun.

For optimal operation of an ammunition magazine, a substantial compression spring force within the magazine body is required in order to properly displace a succeeding ammunition round in sequence towards the magazine's loading end subsequent to the ejection of a preceding ammunition round. It is to be noted that due to the presence of the biasing element within the magazine body, the difficulty associated with loading of the ammunition increases sequentially subsequent to the loading of each ammunition round within magazine body. The difficulty in loading of the ammunition round is attributed to the compression force within the biasing element.

Conventionally, ammunition rounds are stored in rectangular cardboard containers, and a user wishing to load the ammunition rounds into an ammunition magazine must lift an ammunition round and load it into the ammunition magazine one at a time. Loading an ammunition round into the ammunition magazine using the fingers is time consuming. Furthermore, a person suffering from an injury on any one of the fingers may find it difficult to reload the magazine due to the increasing difficulty associated with the loading of each subsequent ammunition round within the magazine body. This is not desired.

As such, there is felt a need of a device that eases the difficulty associated with the loading of the ammunition rounds in the ammunition magazine.

SUMMARY

The present subject matter envisages an ammunition magazine loader. The ammunition magazine loader comprises a loader body defining a pair of guide walls, a front wall, and a back wall. The loader body is configured to facilitate an introduction of a magazine between the guide walls and allow a vertical linear movement of the magazine and a horizontal movement back and forth along a longitudinal axis of the loader body between the guide walls. The guide walls are configured to facilitate placement of a round to be loaded into the magazine therein and facilitate the loading of the round in the loader via the linear movement of the magazine in the loader body.

In one exemplary non-limiting embodiment, the ammunition magazine loader further comprises a hopper extending from the loader body configured to contain a plurality of rounds therein. The hopper is configured to supply one round at a time in the loader body under an effect of a biasing force. In one embodiment, the biasing force is gravity.

In one exemplary non-limiting embodiment, the ammunition magazine loader further comprises a cradle configured on an inner base of the loader body between the guide walls for holding the round therein, the cradle is configured to hold the round in a position aligned with the horizontal linear movement of the magazine to facilitate the loading of the round in the magazine.

In one exemplary non-limiting embodiment, the cradle has a curved profile with a radius to center the round being held therein. In another embodiment, the cradle has a V-shaped profile to center the round being held therein.

In one exemplary non-limiting embodiment, the ammunition magazine loader further comprises a locator tab configured adjacent the cradle between the guide walls, the locator tab configured for facilitating alignment of a magazine with the round to be loaded in the magazine.

In one exemplary non-limiting embodiment, a pair of feed lip slots are configured on both sides of the locator tab and at least a portion of the length of the cradle on both sides for accommodating the pair of magazine lips therein while the loading of the round in the magazine.

In one exemplary non-limiting embodiment, the locator tab has a height greater than that of the cradle. In another embodiment, the locator tab and the cradle are configured substantially centrally on the inner base.

In one exemplary non-limiting embodiment, the hopper is a horizontal hopper extending longitudinally from the loader body. The horizontal hopper has a sloped interior for facilitating provision of biasing force in the form of gravity to the plurality of rounds for being displaced and received into the cradle.

In one exemplary non-limiting embodiment, the hopper is a vertical hopper extending orthogonally from the loader body, the vertical hopper having a sloped interior for facilitating guided movement of the plurality of rounds into the cradle.

The above summary contains simplifications, generalizations and omissions of detail and is not intended as a comprehensive description of the claimed subject matter but, rather, is intended to provide a brief overview of some of the functionality associated therewith. Other systems, methods, functionality, features, and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION OF EXAMPLE EMBODIMENTS

It should be noted that this disclosure includes a plurality of embodiments, with a plurality of elements and aspects, and such elements and aspects need not necessarily be interpreted as being conjunctively required by one or more embodiments of the present invention. Rather, all combinations of the one or more elements and/or aspects can enable a separate embodiment of the present invention, which may be claimed with particularity in this or any one or more future filed non-provisional patent applications. Moreover, any particular materials, structures, and/or sizes disclosed herein, whether expressly or implicitly, are to be construed strictly as illustrative and enabling, and not necessarily limiting. Therefore, it is expressly set forth that such materials, structures, and/or sizes independently or in any combination thereof, are merely illustratively representative of one or more embodiments of the present invention and are not to be construed as necessary in a strict sense.

Further, to the extent the same element or aspect is defined differently within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent therefrom. However, it is expressly set forth that these benefits are not intended as exclusive. Therefore, any explicit, implicit, or apparent benefit from the disclosure herein is expressly deemed as applicable to the present invention.

According to the present invention, a magazine loader can be formed from any one or more materials or combinations of materials, such as one or more of plastic, rubber, wood, metal, a crystalline material, or any other man-made or naturally occurring material, for example and not in limitation, insofar as the same if functionally consistent with the invention as described. Further, a loader can be manufactured in any one or more functionally compatible manners, such as through molding, machining, etc.

Notably, the present invention includes particular structural aspects described herein that allow for particular movement of rounds for subsequent loading into a magazine, such as a single feed magazine, for example and not in limitation.

Figure 1:
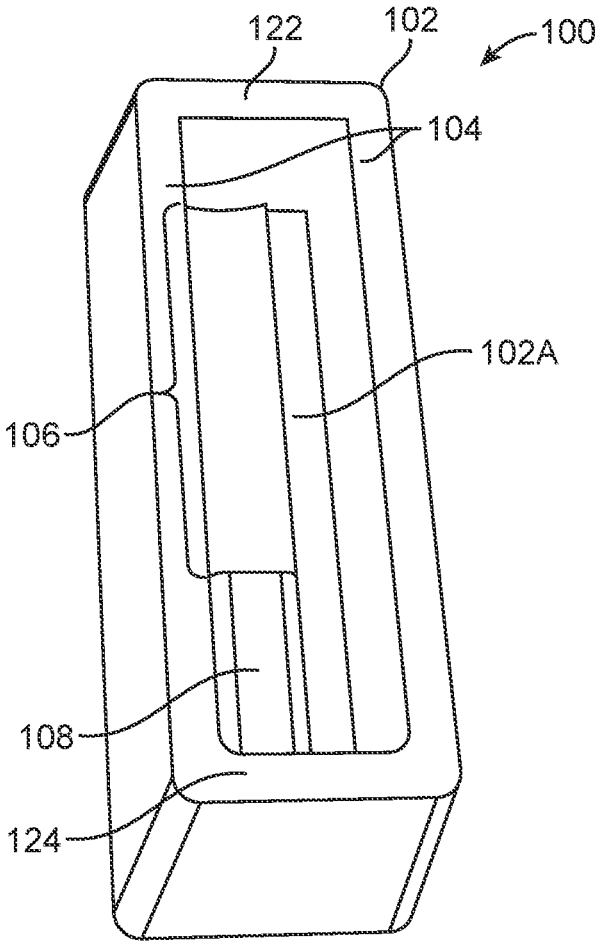
FIG. 1 illustrates a perspective view of an ammunition magazine loader, in accordance with one embodiment of the present subject matter.
Figure 2:
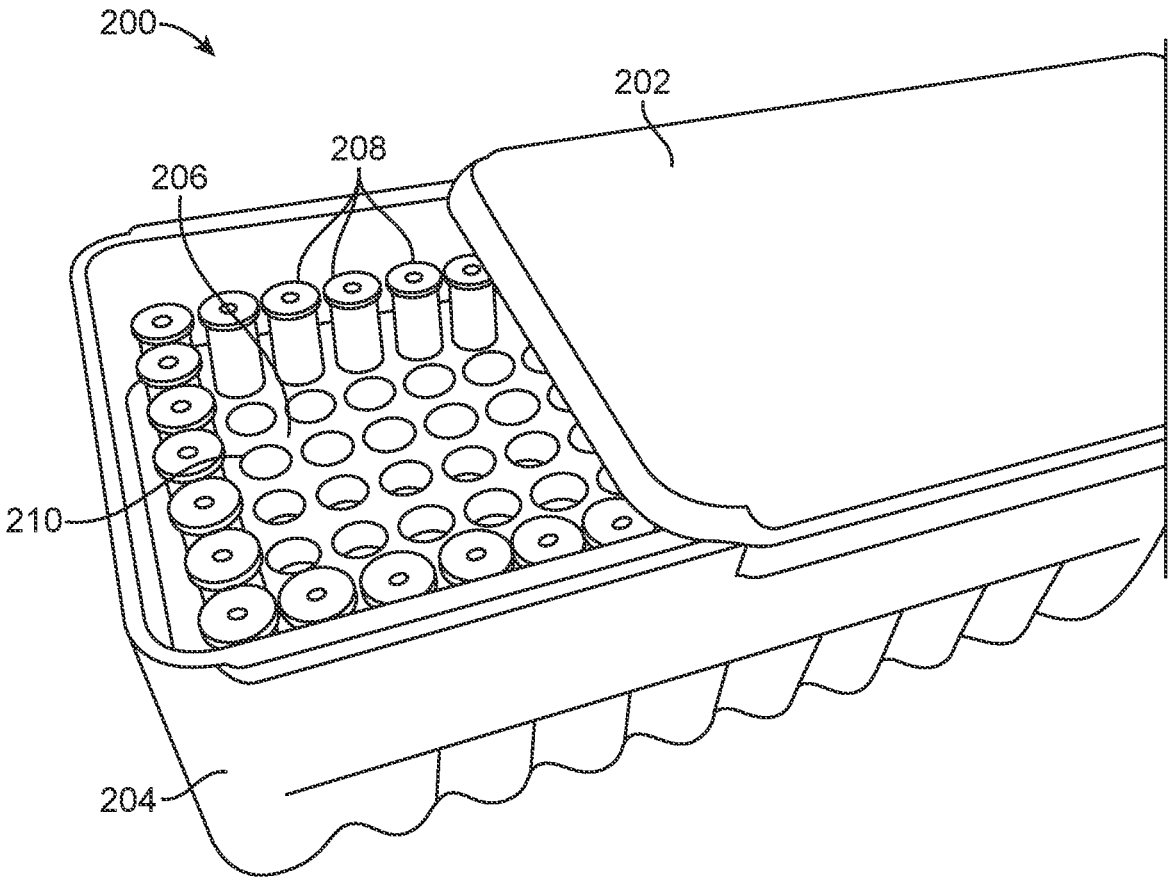
FIG. 2 illustrates a schematic view of an ammunition storage unit, in accordance with one embodiment of the present subject matter.

Referring to FIGS. 1 and 2, a first embodiment of an ammunition magazine loader embodying aspects of the present invention is designated generally by the reference number 100. The ammunition magazine loader 100 is configured for loading several rounds of ammunition, also referred to as cartridges, into a handgun or rifle magazine in a relatively short time period. The ammunition magazine loader 100 reduces hand fatigue associated with loading the magazine. As will become apparent in the illustrated embodiments, the ammunition magazine loader 100 is a universal handgun or rifle magazine loader in that it can be used to load a plurality of types of cartridges (within a given range of sizes) into a plurality of types of handgun or rifle magazines from different magazine manufacturers. Multiple devices can be designed for "single stack" or "double stack" magazines, for various types of handguns or rifles and for various calibers.

FIG. 1 illustrates a perspective view of an ammunition magazine loader 100, in accordance with an embodiment of the present subject matter. The magazine loader 100 comprises a loader body 102. As seen in FIG. 1, the loader body has a rectangular shape. However, it is to be noted that the loader body 102 is not limited to being rectangular and may have any suitable shape in accordance with the shape and size of a magazine in which a round has to be loaded. The loader body 102 includes a pair of guide walls 104, a front wall 122, and a back wall 124. As seen in FIG. 1, an inner base of the loader body 102 has two distinct sections defined thereon. A cradle 106 and a locator tab 108 are defined on the inner base of the loader body 102.

The present subject matter envisages an ammunition storage unit 200, which may be used with the ammunition magazine loader 100. FIG. 2 illustrates a perspective view of the ammunition storage unit 200 in accordance with an embodiment of the present subject matter. The ammunition storage unit 200 may be made of a rigid material and have a lid 202 and a box 204. The box 204 may be configured to securely contain therein a number of rounds 208. The ammunition storage unit 200 may be designed to contain therein different types of rounds in different quantities, e.g., the ammunition storage unit 200 may be designed to store therein 9 mm, .380, .22, .45, .357, and other kinds of rounds as well. An advantageous aspect of the using the ammunition storage unit 200 is that it is more durable as compared to the typical cardboard boxes. The lid 202 facilitates one handed opening and closing thereof. Another advantageous aspect of the ammunition storage unit 200 is that it can be used to store not just very similar in size calibers like 9 mm and .380 automatic, but significantly different calibers like 9 mm and .22 caliber by simply changing an insert 206 within the box 204. The insert 206 comprises a plurality of holes 210, wherein the plurality of holes 210 are designed based on the type of round being accommodated therein. The storage unit 200 is described in more detail in the subsequent sections of the present subject matter.

Referring to FIG. 1, the cradle 106 is the section at a base 102A of the loader body 102 in which the round that is to be loaded into the magazine is accommodated. The cradle 106 is designed to facilitate secure accommodation of the round at a particular height and centered between the guide walls 104, for facilitating loading of the round in the magazine smoothly. If a magazine happens to be designed such that the location that the rounds enter and exit the magazine is off center from the magazine body, then an appropriately designed loader would require the cradle to be off center from the guide walls a similar amount.

Figure 3:
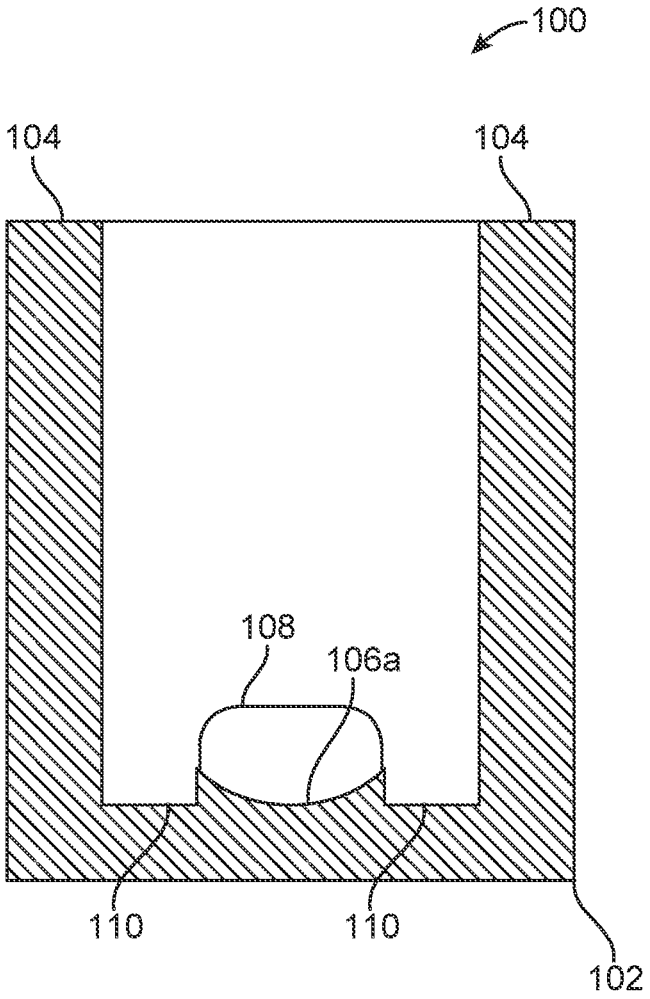
FIG. 3 and FIG. 4 illustrate sectional views the ammunition magazine loader, in accordance with embodiments of the present subject matter.

In one embodiment, as seen in FIG. 3, the cradle 106*a* has a curved profile. A radius of the curvature of the curved profile of the cradle may be substantially equal to a radius of the round that is to be accommodated thereon, in accordance with one embodiment. In another embodiment, the radius of the curved profile may be more or less than that of the round being accommodated therein.

Figure 4:
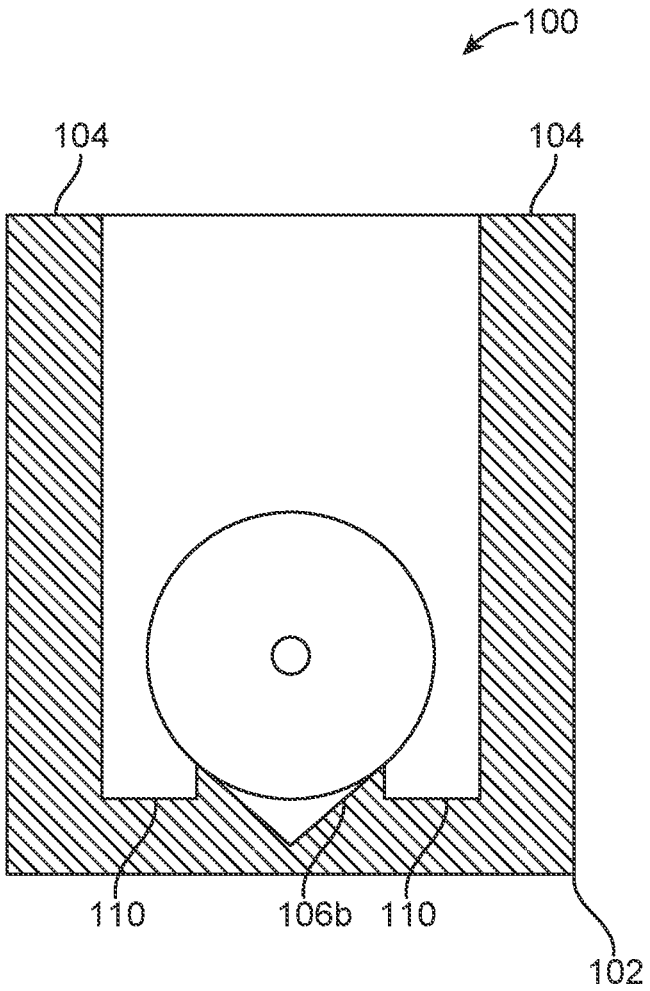

In another embodiment, as seen in FIG. 4, the cradle 106*b* may have a V-shaped profile designed to securely accommodate or hold the round to be loaded into the magazine therein at a particular height. It is to be noted that the cradle 106*b* may have any other shape for the design as well as per the application requirements.

Referring back to FIG. 1 and FIG. 3, the locator tab 108, in accordance with one embodiment, is a protrusion extending from the base 102A (seen in FIG. 1) of the loader body 102 adjacent the cradle 106. A pair of feed lip slots 110 are formed on either side of the locator tab 108 and may extend at least a portion of the length of the cradle 106 on both sides. In an embodiment, the locator tab 108 has a height greater than that of the cradle 106 to facilitate the appropriate placement of the round in the cradle 106. The feed lip slots 110 are configured to receive and accommodate therein a pair of magazine feed lips when the magazine is introduced between the guide walls 104. In accordance with one aspect, the height of the locator tab 108 is designed to facilitate appropriate placement of the round in the cradle 106, while at the same time ensuring that the height and width of the locator tab 108 does not interfere with or restrict the movement of the magazine between the guide walls 104 along the length of the loader body 102. Once the alignment of the magazine and the round to be loaded, which is placed in the cradle, is established by the guide walls 104, the magazine is then slid across the guide walls 104, and the round to be loaded is pushed against the front wall 122 of the loader body 102 until it is finally loaded into the magazine via the front of the magazine so that the pair of magazine lips can then hold the round in against the magazine spring before the downward pressure on the magazine can be released. The process of loading the round into the magazine using the ammunition magazine loader 100 is hereinafter described.

Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "outboardly," "inboardly," "forwardly," "backwardly," "portwardly," and "starboardly," should not be interpreted to limit the scope of the invention recited in the attached claims.

Figure 5:
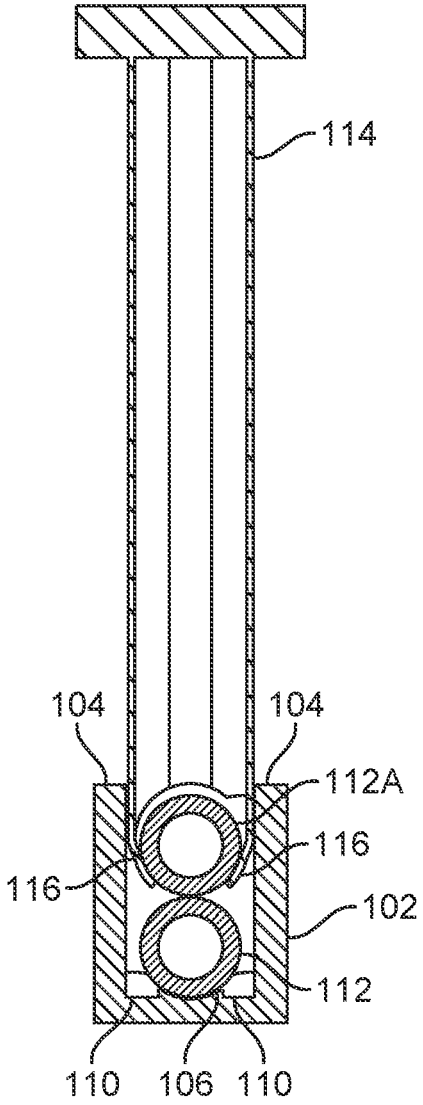
FIG. 5 illustrates a sectional view of a magazine being introduced into the loader body, in accordance with an embodiment of the present subject matter.

In the present description of the preferred embodiments of the invention, all movements are relative in relation to the ammunition magazine loader 100. For example, directing the magazine 114 down into the loader 102 is functionally equivalent to moving the loader 102 up and around the magazine 114. Similarly, sliding the magazine 114 forward in the guide walls 104 to load the round is functionally equivalent to moving the loader 102 in the opposite direction. Therefore, whenever the movement of a component is referenced herein, while another component is relatively stationary, a movement of the stationary component in the opposite direction while maintaining the formerly moving component stationary is hereby claimed. Likewise, relative motion of both components in relation to each other is another possible configuration with the present invention, FIG. 5 illustrates a sectional view of a magazine 114 being introduced into the loader body 102, in accordance with an embodiment of the present subject matter. Referring to FIG. 5, a round 112 is placed in the cradle 106. The round 112 is to be loaded into a magazine 114. The magazine 114 includes the pair of magazine feed lips 116. The magazine 114 is shown to have another round 112A preloaded into the magazine 114. For loading the round 112 into the magazine 114, the magazine 114 is first introduced between the guide walls 104, as shown in FIG. 5. Once introduced between the guide walls 104, the magazine 114 is moved downwards until the pair of magazine feed lips 116 pass behind the round 112, thereby not interfering with the downward motion, and are accommodated into the feed lip slots 110, and then the magazine 114 is slid across the length of the guide walls 104 until the round 112 held in the cradle 106 is loaded into the magazine 114 within the pair of magazine feed lips 116. In an exemplary aspect, a round 112, which may include a case and projectile, can be a live or blank round.

Figure 6:
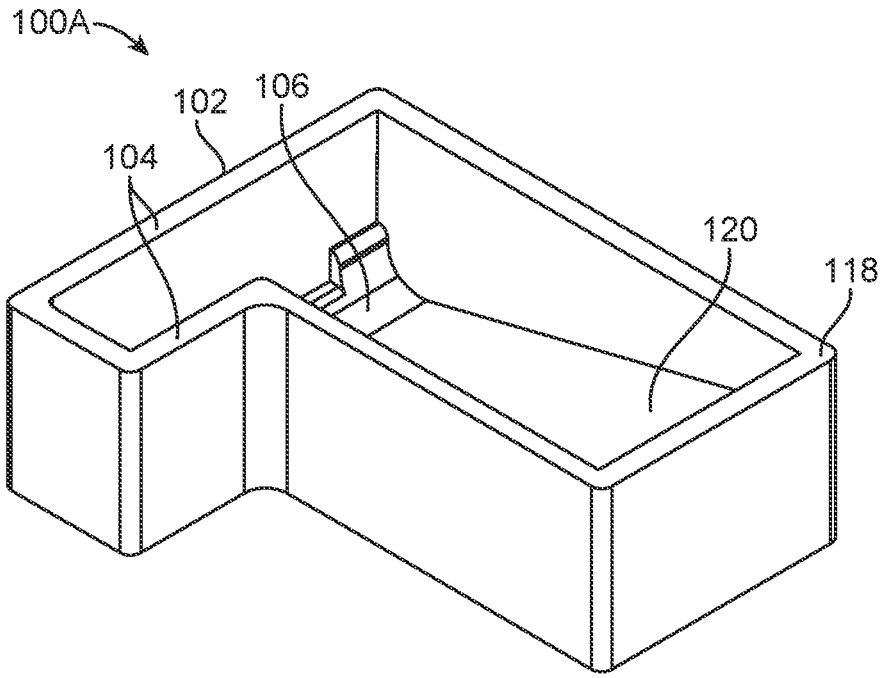
FIG. 6 illustrates a perspective view of the ammunition magazine loader with a horizontal hopper, in accordance with another embodiment of the present disclosure.

FIG. 6 illustrates a perspective view of the ammunition magazine loader 100A with a horizontal hopper 118, in accordance with another embodiment of the present disclosure. The horizontal hopper 118, as seen in FIG. 6, extends horizontally from the loader body. It is to be noted that the structure and configuration of the loader body 102 of the ammunition magazine loader 100A is functionally identical to that of loader body 102 of ammunition magazine loader 100 described in FIG. 1, FIG. 3, FIG. 4, and FIG. 5. As such, the same is not repeated for the sake of brevity of the present document. Furthermore, the like elements of ammunition magazine loader 100 and ammunition magazine loader 100A are referenced via like numerals for the sake of simplicity and ease of readability.

Referring to FIG. 6, the ammunition magazine loader 100A is designed for being used while being placed on a flat surface, such as a table. The horizontal hopper 118 extends integrally from the loader body 102. The horizontal hopper 118 is configured to hold a plurality of rounds therein. The horizontal hopper 118 has a sloped section 120, wherein the sloped section 120 is the base on which the rounds are placed. A biasing force in the form of gravity propels the movement of the rounds into the cradle 106 from the sloped section 120. In another embodiment, a spring may also be used as a biasing means to facilitate the loading of the rounds in the cradle. As mentioned previously, the cradle 106 may have a curved profile, a V-shaped profile, or any other profile designed to center the round in the cradle 106. The process of loading the round into the magazine using the ammunition magazine loader 100A is hereinafter described.

Figure 7A:
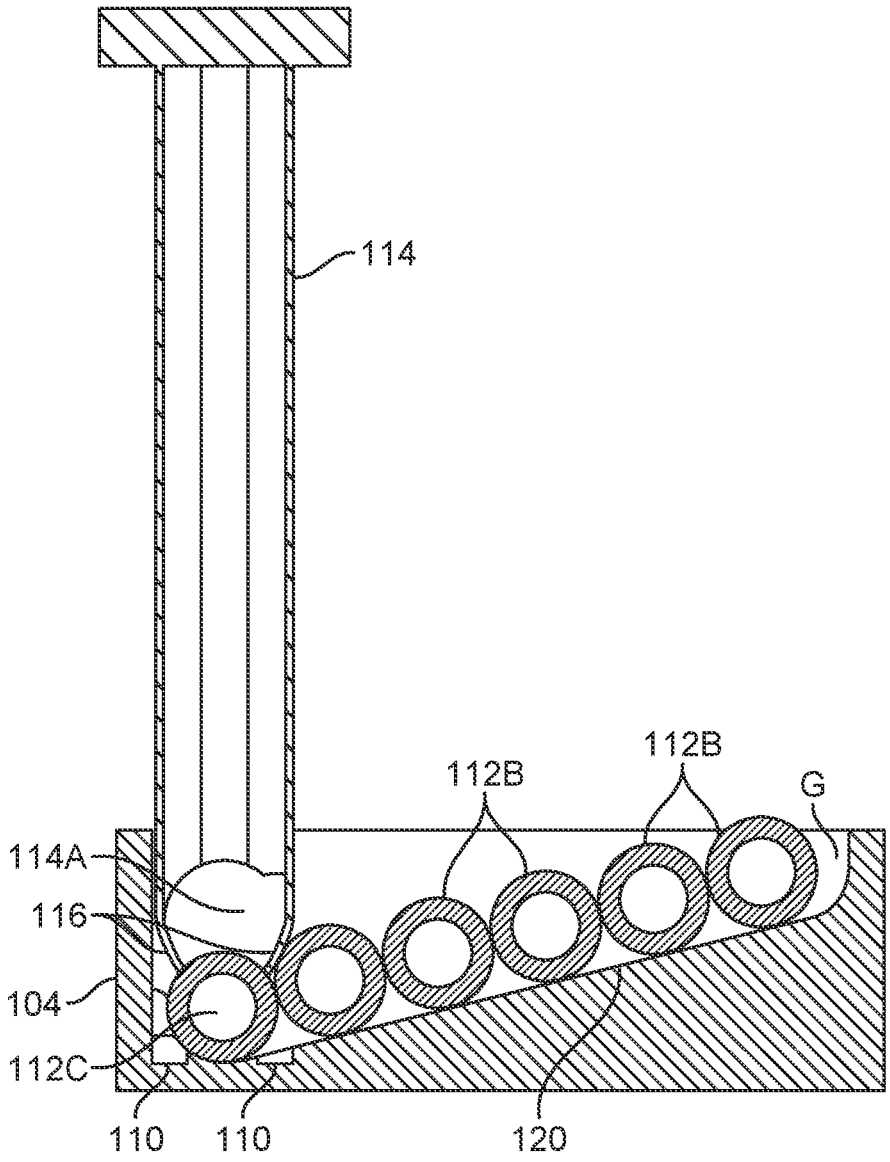
FIG. 7A and FIG. 7B illustrate views depicting a first position of the magazine in the process of loading a round in the magazine, in accordance with an embodiment of the present subject matter.
Figure 7B:
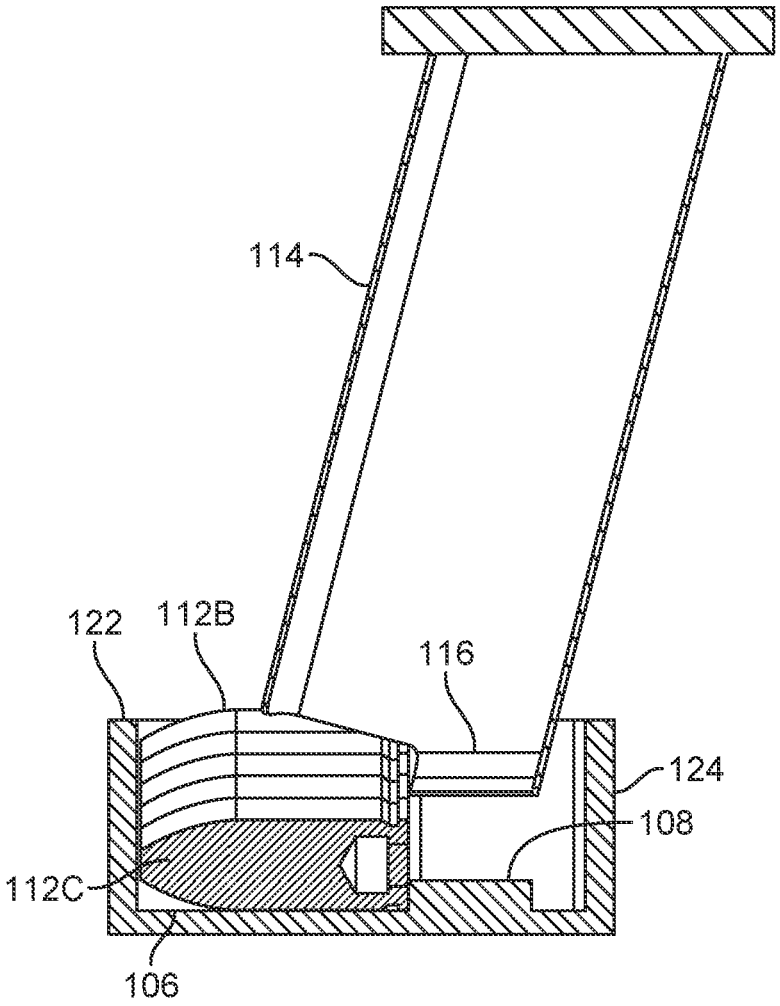
Figure 9A:
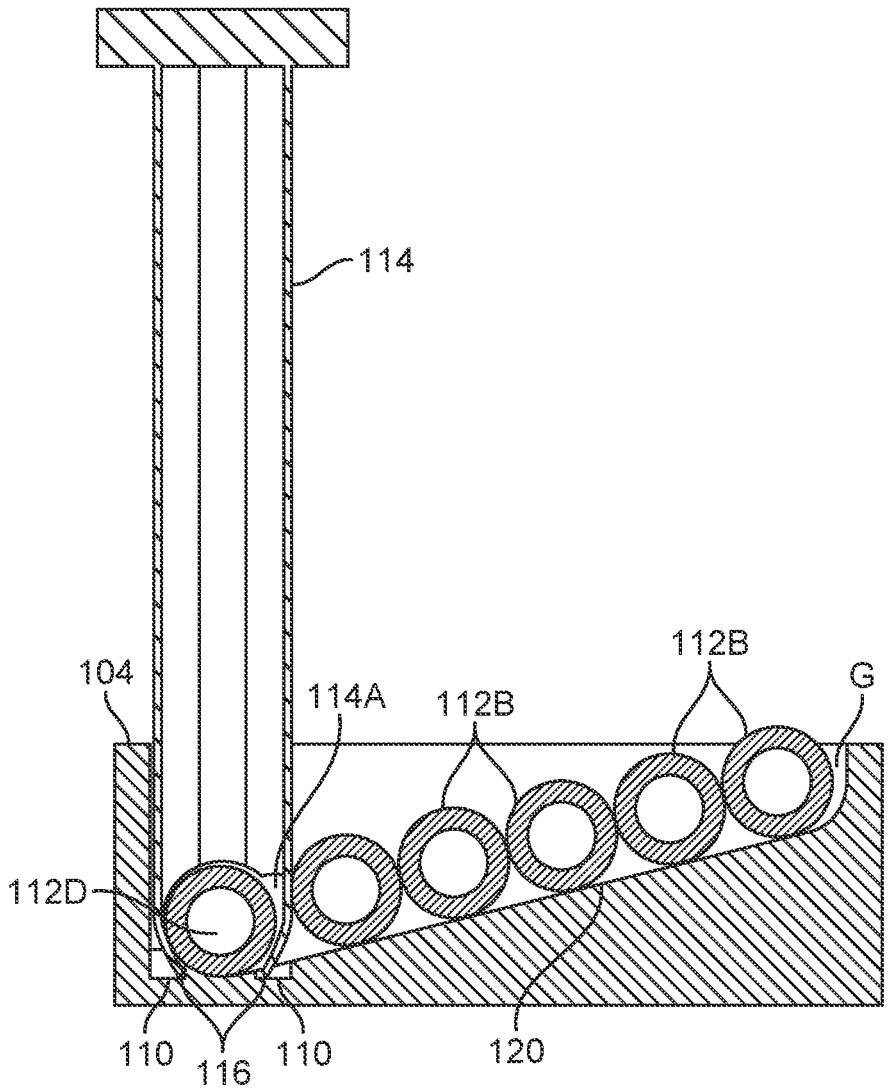
FIG. 9A and FIG. 9B illustrate views depicting a third position of the magazine in the process of loading a round in the magazine, in accordance with an embodiment of the present subject matter.
Figure 9B:
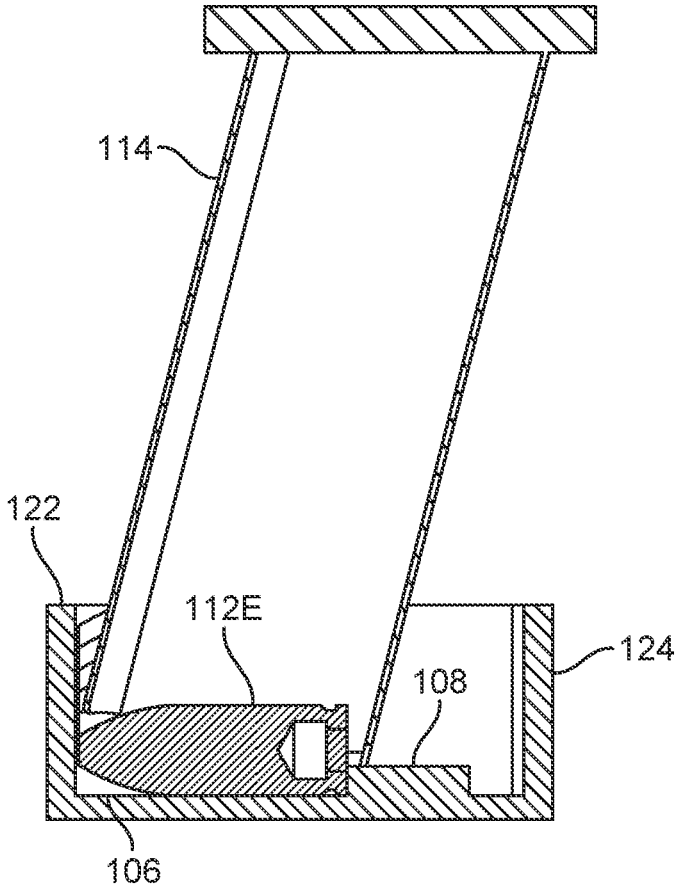

Referring to FIG. 7A and FIG. 7B, a first position of the magazine 114 in the process of loading the rounds 112B, 112C in the magazine 114, is illustrated. As used hereinafter in the present document, the reference numeral 112B is used to refer to a round in the hopper (atop the sloped section 120); 112C is used to refer to the round in the cradle 106; 112D is used to refer to a round in the process of loading; and 112E refers to a round loaded into the magazine. In the first position, the magazine 114 is just introduced between the guide walls 104. Due to the location of this cross section only one of the guide walls 104 is shown while the other guide wall is interrupted at this point in the cross section, and is therefore not shown. In the first position, the magazine 114 is aligned with the guide walls 104 such that the pair of magazine feed lips 116 are aligned with the feed lip slots 110. Note in FIG. 7B that the locator tab 108 maintains the round 112C in the cradle at one end of the loader body to ensure that the magazine feed lips 116 travel behind the round 112C so that when the magazine is slid forward as shown in FIG. 9B the magazine lips will travel below the round 112D, when the magazine is properly inserted as shown in FIG. 7B. The front wall 122 and the locating tab 108 create boundaries for the round 112D to prevent significant longitudinal movement when the round 112D is in the cradle 106, just as the curve or "v" shape or other such geometry of the cradle 106 forms lateral boundaries for the round 112D.

Figure 8:
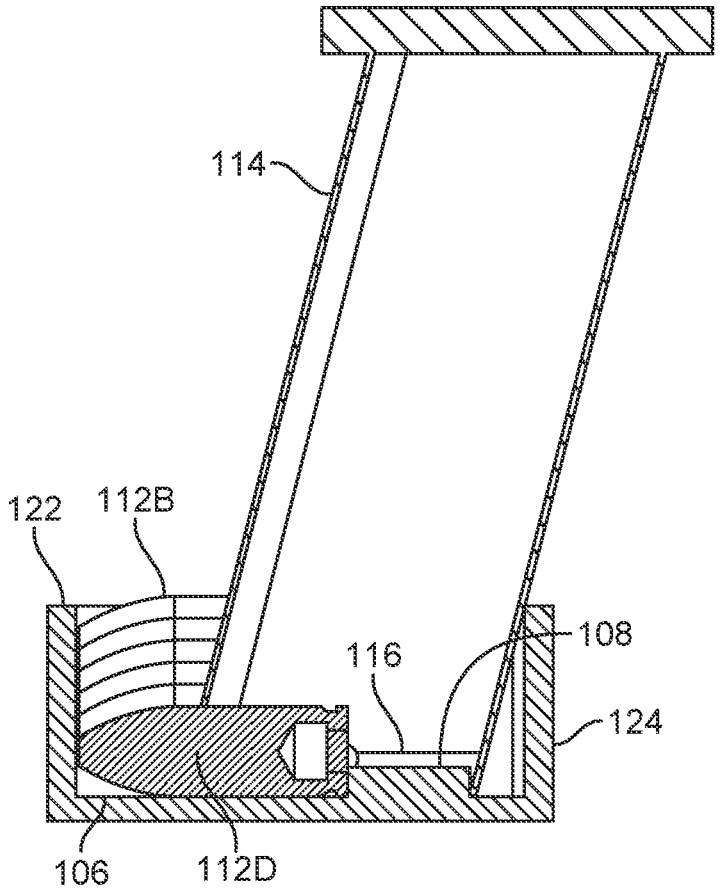
FIG. 8 illustrates a view depicting a second position of the magazine in the process of loading a round in the magazine, in accordance with an embodiment of the present subject matter.

Referring to FIG. 8, a second position of the magazine 114 in the process of loading the round 112D in the magazine 114, is illustrated. Subsequent to aligning the magazine with the guide walls 104, the magazine 114 is pressed down until the feed lips 116 touch, or nearly touch, the bottom of the feed lip slots 110 which accommodate the feed lips 116 as illustrated in FIG. 9A. Once the magazine feed lips 116 are accommodated into the feed lip slots 110, a magazine feed opening 114A (as shown in FIG. 7A) in the front of magazine 114 aligns with the round 112D, which can also be clearly seen in FIG. 8 and FIG. 9B. When magazine 114 is pressed downwards, the magazine 114 also may come into surface contact with a back wall 124 of the loader body 102. The back wall 124 extends perpendicularly from the base of the of the loader body 102. However, in another embodiment, the back wall 124 may be angled to approximately match the angle at which the magazine 114 makes contact therewith.

Referring to FIG. 9A and FIG. 9B, a third position of the magazine 114 in the process of loading the round in the magazine 114, is illustrated. The ammunition magazine loader 100A has a front wall 122. The front wall 122 forms limit the cradle 106. More specifically, the front wall 122 blocks the round 112D placed in the cradle 106 from lateral movement during loading. In the third position, the magazine 114 is slid across the length of the guide walls 104 such that the round 112D is received into the magazine 114 in between and above the magazine feed lips 116. While the magazine 114 is slid across, the round 112D is pushed against the front wall 122 and the front wall 122 holds the round 112D in place until it is loaded into the magazine 114. The pair of feed lip slots 110, in accordance with one embodiment, may have an internal width substantially equal to the width of the locator tab 108. In another embodiment, the feed lip slots 110 may extend from the back wall 124 to a location close to the front wall 122, and not completely up to the front wall 122. In one embodiment, the feed lip slots 110 may extend along the entire length of the loader body 102 from the back wall 124 to the front wall 122. An advantageous aspect of such a configuration of the feed lip slots 110 is that it allows optimal accommodation of the magazine lips therein and allows smooth movement of the magazine along the length of the loader body 102 to facilitate the loading of the round in the magazine.

Referring to FIG. 7A and FIG. 9A, an important consideration in the design of horizontal hopper 118 is the provision of the gap G. The gap G may be provided to accommodate the movement of the row of the rounds 112B when the loading is being performed. More specifically, when the magazine 114 is being pushed down across the guide walls 104, the side of the magazine 114 tends to push the row of rounds 112B, which displaces them, wherein the displacement is accommodated by the gap G, as seen in FIG. 7A, with a larger more pronounced gap G, and in FIG. 9A, with a smaller gap G due to the movement.

Referring to FIG. 9B, after the round 112E is loaded into the magazine 114, the magazine 114 is pulled out of the guide walls 104, and another round 112B from the hopper enters into the cradle 106. When the magazine 114 is pulled out of the guide walls 104, the next round in the row of the rounds 112B within the hopper then enters the cradle 106 to be loaded into the magazine 114. In embodiments without a hopper, the next round 112 to be loaded is inserted into the cradle 106.

In another embodiment, if the rounds are inserted actively and automatically the next round may not necessarily be partially in the cradle 106, and therefore the downward motion of the magazine 114 need not move the successive rounds back. The hopper 118 may be slightly offset from the area where the rounds are to go into the cradle 106. When the magazine 114 is pushed forward to bring the round into the magazine 114, the magazine 114 can additionally push against a mechanism which pushes the next round into a chamber adjacent to the cradle 106 where the round goes for loading. Then when the magazine 114 is pulled up the next round can enter the cradle 106 without another following it until the magazine 114 is brought forward again.

In yet another embodiment, if the rounds are allowed to go in manually, the next round can be inserted into the cradle 106 with the press of a button or rotation of a knob, or other manual mechanism to move the round from the hopper 118 to the cradle 106.

Figure 10:
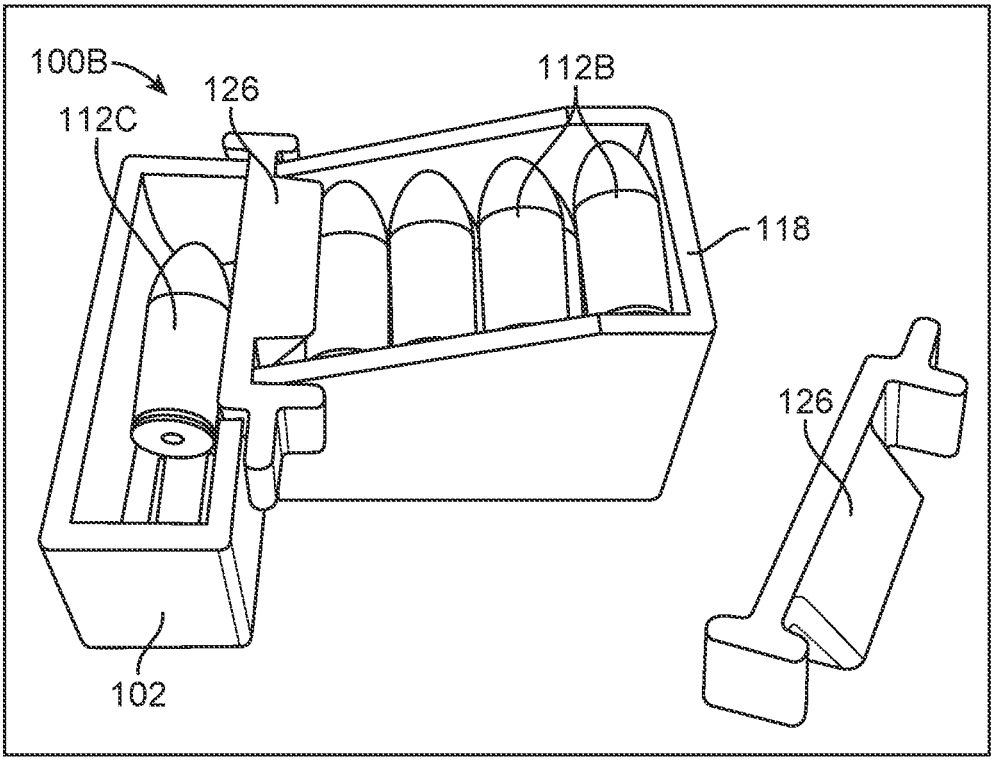
FIG. 10 illustrates a perspective view of an ammunition magazine loader employing the use of an angled guide, in accordance with yet another embodiment of the present subject matter.

FIG. 10 illustrates a perspective view of an ammunition magazine loader 100B employing the use of an angled guide 126, in accordance with yet another embodiment of the present subject matter. The horizontal hopper 118, as seen in FIG. 10, is configured for containing more than one row of rounds 112B therein. In such a configuration, the rounds 112B from the lower row travel smoothly to the cradle, however, the rounds from the upper rows may get jammed up and not load. As such, in order to facilitate guided and optimal ejection of all the rounds 112B from the hopper 118 into the cradle 106, the angled guide 126 is installed at the junction of the hopper 118 and the loader body 102. As seen in FIG. 10, the angled guide 126 may be a discreet component attachable externally on the loader 100B. In another embodiment, the angled guide 126 may be manufactured integral to the loader 100B. In another embodiment the angled guide 126 could be vertical, as simply a wall to ensure that only one row of rounds 112B exits the hopper into the cradle.

Figure 11:
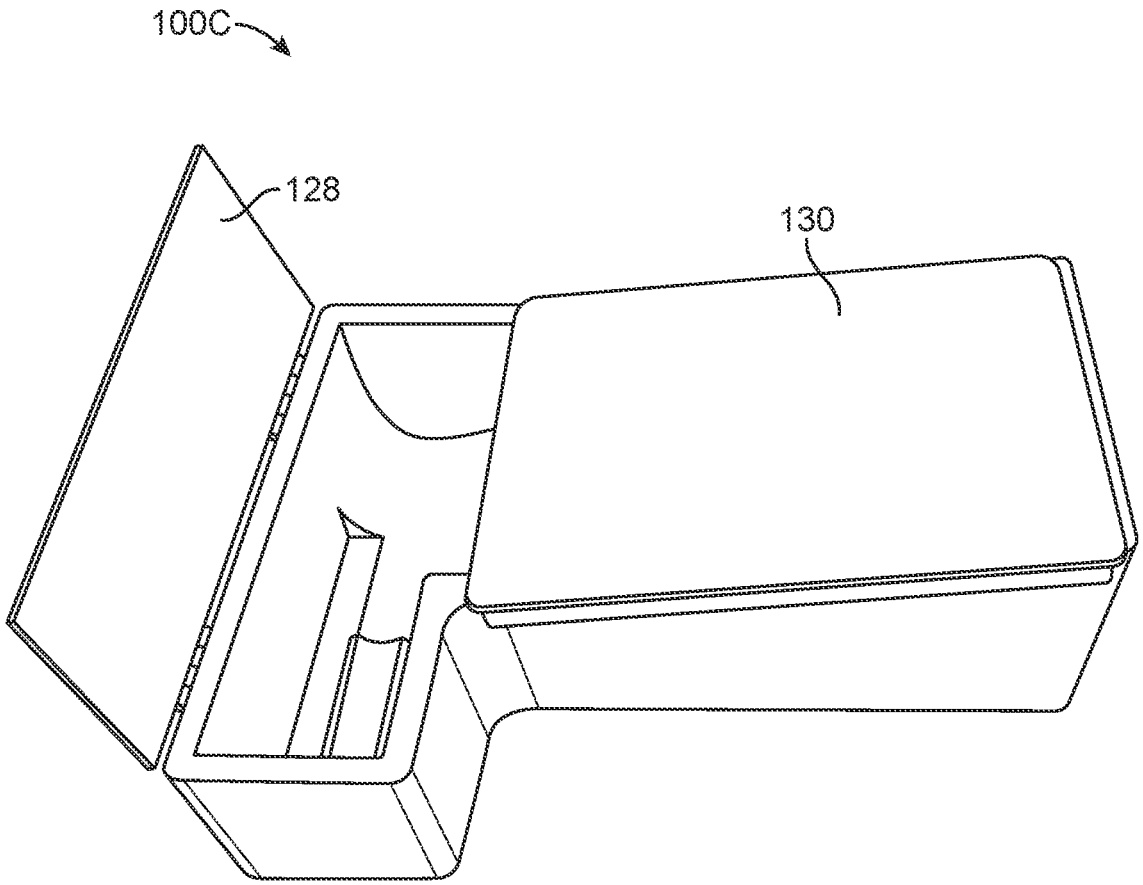
FIG. 11 illustrates a perspective view of an ammunition magazine loader with lids, in accordance with yet another embodiment of the present subject matter.

FIG. 11 illustrates a perspective view of an ammunition magazine loader 100C with lids, in accordance with yet another embodiment of the present subject matter. The loader 100C has lids 128, 130. The lids 128, 130 facilitate the operation of the loader 100C as a magazine loader as well as a storage unit. The lids 128, 130 may be configured for one of hinged connection, sliding connection, and latch connection with the loader 100C.

Figure 12:
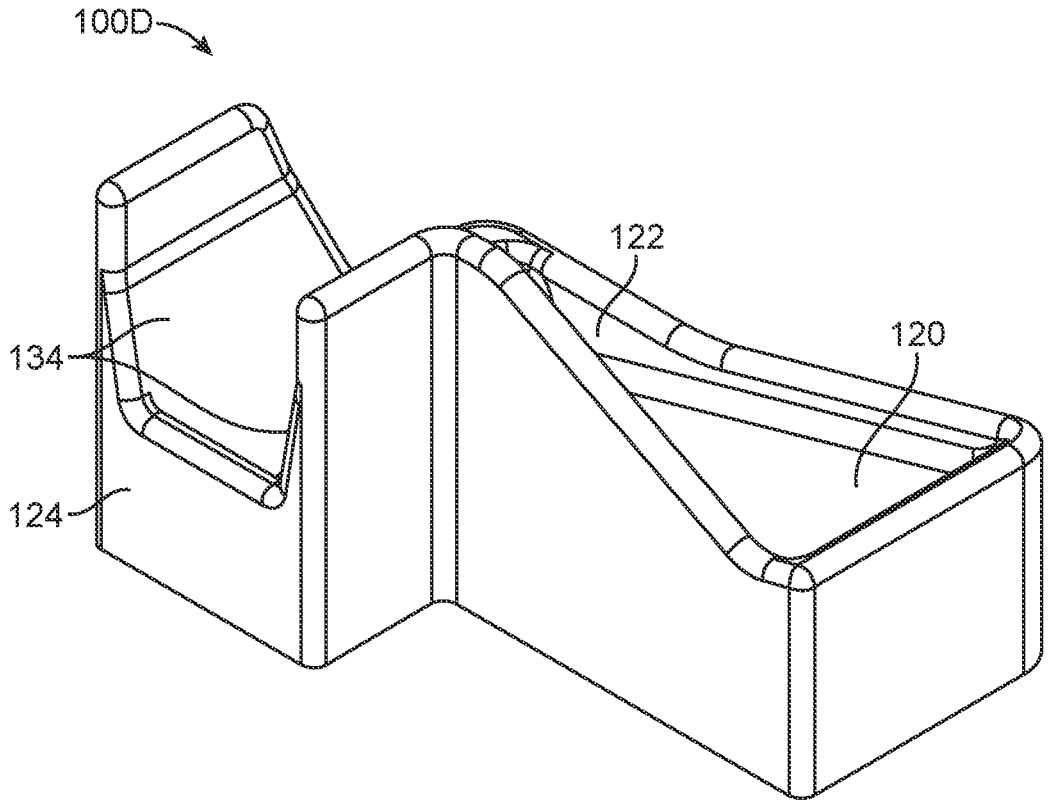
FIG. 12 through FIG. 14 illustrate different views of an ammunition magazine loader, in accordance with yet another embodiment of the present subject matter.
Figure 13:
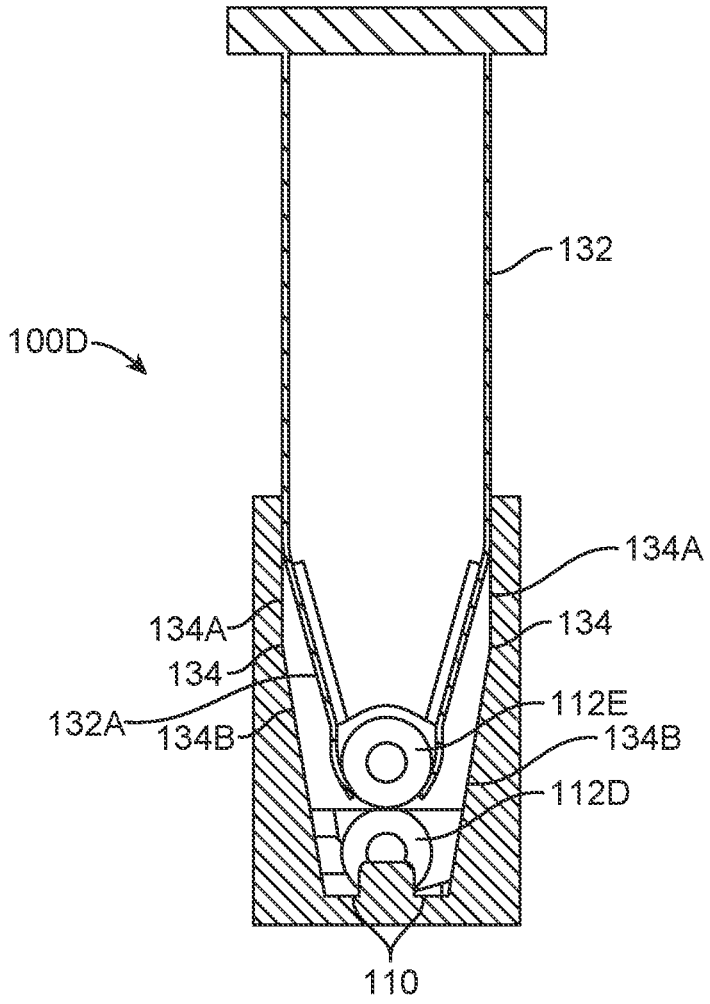
Figure 14:
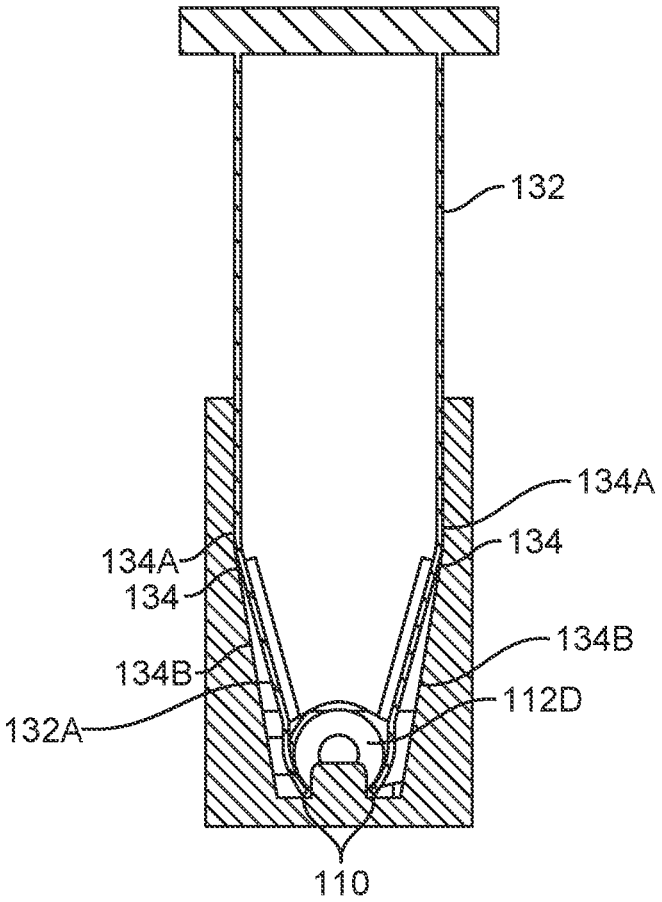

FIG. 12 through FIG. 14 illustrate different views of an ammunition magazine loader 100D, in accordance with yet another embodiment of the present subject matter. The loader 100D is configured to facilitating ammunition round loading in a double stacked magazine 132. The double stack magazine 132 is significantly wider than the single stack magazine 114 and typically tapers at the end. The design of the guide walls 134 is modified in loader 100D to accommodate the double stack magazine 132. The guide walls 134 define a straight portion 134A and an optional tapered portion 134B. As illustrated in FIG. 13, a tapered end 132A of the double stack magazine 132 is far from contact with the tapered portion 134B of the guide walls 134 when first entering the loader 100D. As illustrated in FIG. 14, it is not until the double stack magazine 132 is all of the way down before the tapered end 132A of the double stack magazine 132 could be guided by the tapered portion 134B of the guide walls 134. Therefore, in one preferred embodiment, as illustrated in FIG. 13, the straight portion 134A of the guide walls 134 are extended so that they guide the double stack magazine 132 at the point that the round 112E inside the magazine 132 presses on the round 112D in the cradle. At this point the two rounds 112D, 112E tend to roll to the side of one another when the magazine is pressed down. The longer guide walls 134 assist the user in maintaining the magazine 132 vertical and aligned with the round 112 being loaded.

Figure 15:
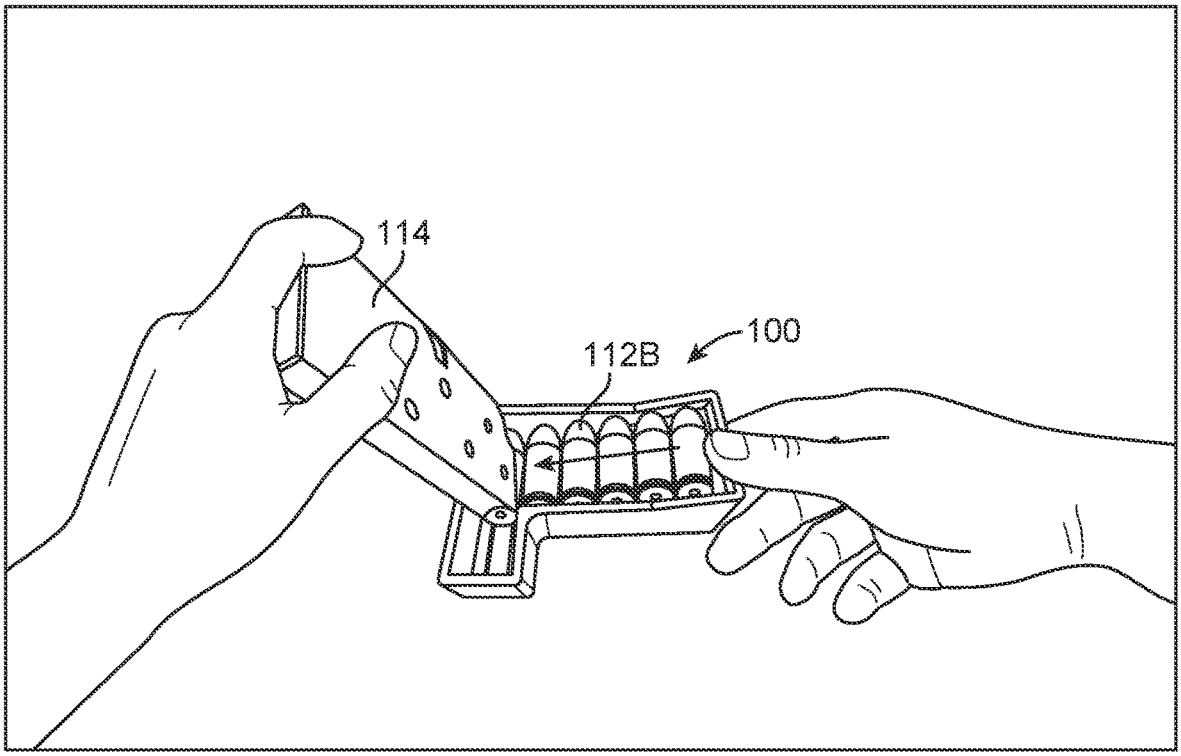
FIG. 15 illustrates a schematic view depicting the actual operation of the ammunition magazine loader, in accordance with an embodiment of the present subject matter.

FIG. 15 illustrates a schematic view depicting the actual operation of the ammunition magazine loader 100, in accordance with an embodiment of the present subject matter. As seen in FIG. 15, the loader configurations 100, 100A, 100B, 100C, 100D are designed to be handy, easy to operate, and easy to carry due to their compact size.

Figure 16:
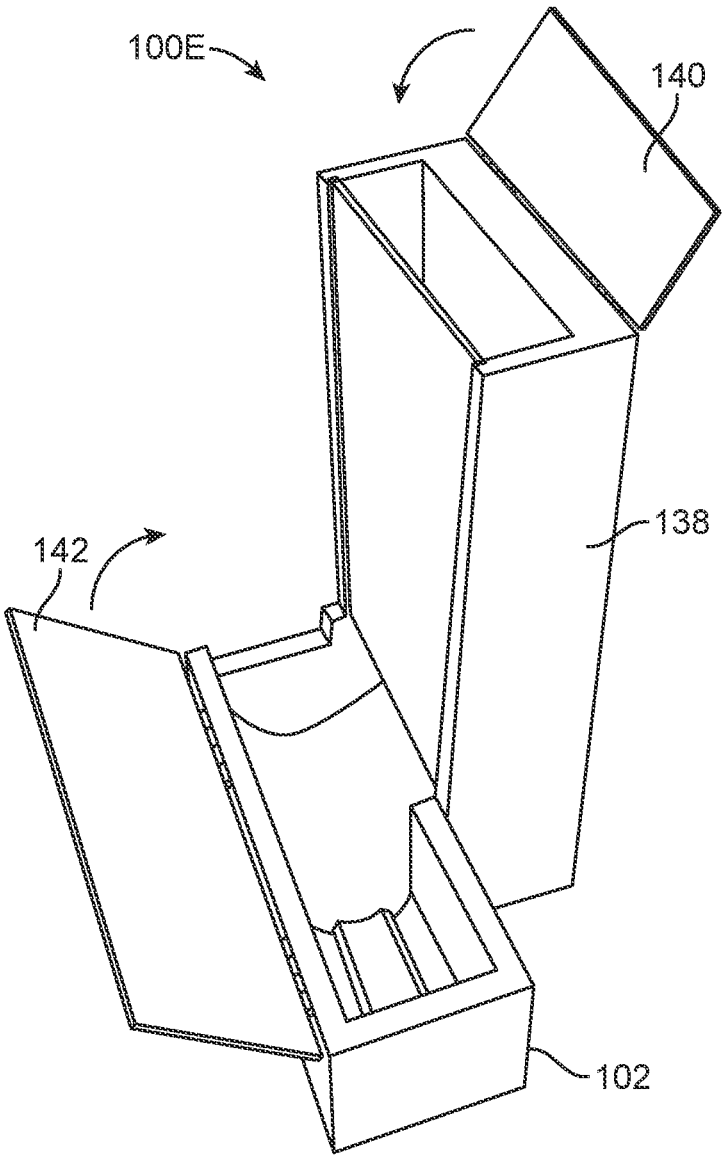
FIG. 16 illustrates a perspective view of an ammunition magazine loader with a vertical hopper, in accordance with yet another embodiment of the present subject matter.

FIG. 16 illustrates a perspective view of an ammunition magazine loader 100E with a vertical hopper 138, in accordance with yet another embodiment of the present subject matter. The vertical hopper 138 extends vertically from the loader body 102 of the loader 100E. The vertical hopper 138 may have a sloped interior similar to that of the horizontal hopper 118. In this way, the biasing force downward of the rounds in the vertical hopper, combined with the biasing force to the side of the sloped interior bottom encourage the next round into the cradle. The loader 100E in FIG. 16, similar to loader 100D, includes optional lids 140, 142 for increasing the functionality of the loader 100E to a storage unit as well.

Referring back to FIG. 2, the lid 202 for the box 204 slides on and off rather than opening with a hinge. In this way the lid 202 can be slid the distance of one row of rounds, and the box can be turned upside down to allow the emptying of one row of rounds into the hand or onto a table. Then the lid 202 may be slid one row further for removing another row of rounds. Once the center of the box 204 is reached, the lid 202 may be slid all of the way closed again and then slid in the other direction to expose one or more rows at a time for removal. The storage units 200 may be manufactured in different sizes for accommodating different kinds of rounds therein. The storage units 200 may be sized differently to have same length and width but different heights to cater different round lengths and stacking requirements.

Referring to FIG. 2, an advantageous aspect of the storage units 200 is that they are more durable than cardboard, even to the point of potentially being able to survive a drop onto concrete. The storage units 200 may be opened with one hand. In accordance with one aspect, one or more of the components of the storage units 200 may be color coded to differentiate between rounds before opening them.

According to a one embodiment, there is provided an ammunition storage unit 200 comprising a molded box body of polymeric material with an open top. In one embodiment, the polymer is thermoplastic material e.g., polypropylene or polyethylene. In another embodiment, the ammunition storage unit 200 may be constructed of any suitable material, such as but not limited to, polymer, composite material, metal, wood, elastomer (e.g., rubber) and others. In another embodiment, the ammunition storage unit 200 may be made of a transparent or a translucent material to be able to see how many rounds were left in the box before opening the box.

Figure 17A:
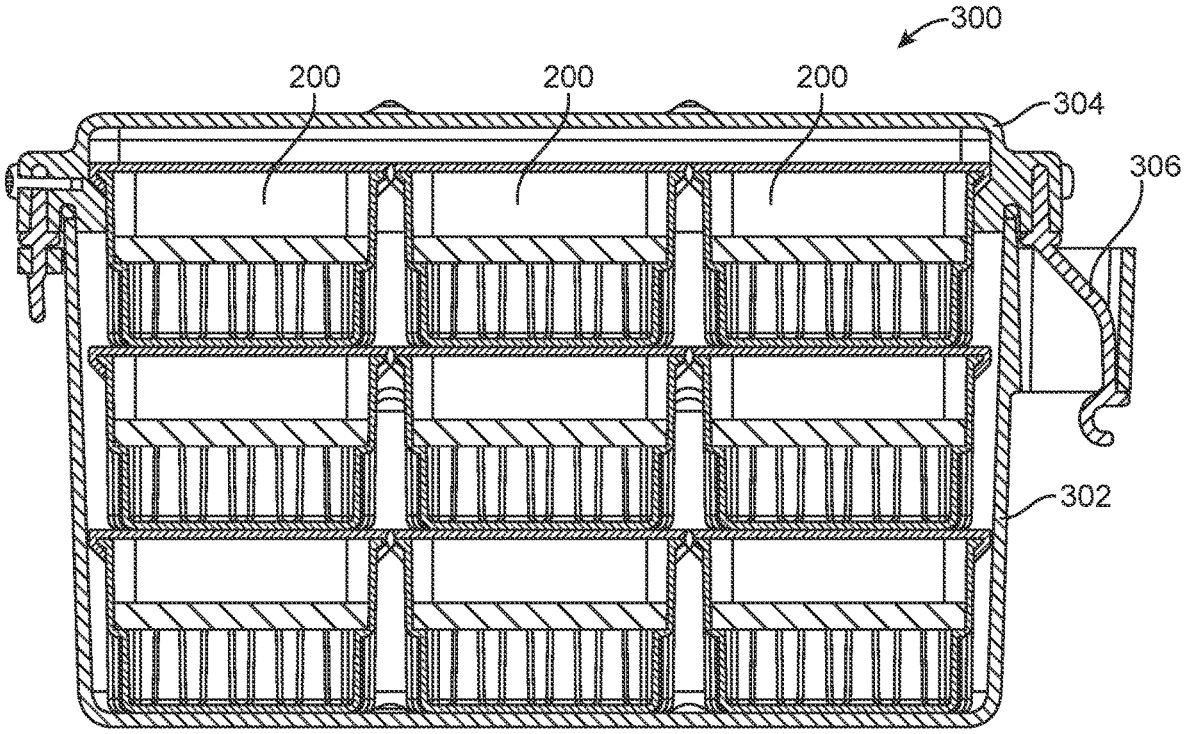
FIG. 17A and FIG. 17B illustrate schematic views of a master storage container, in accordance with an embodiment of the present subject matter.
Figure 17B:
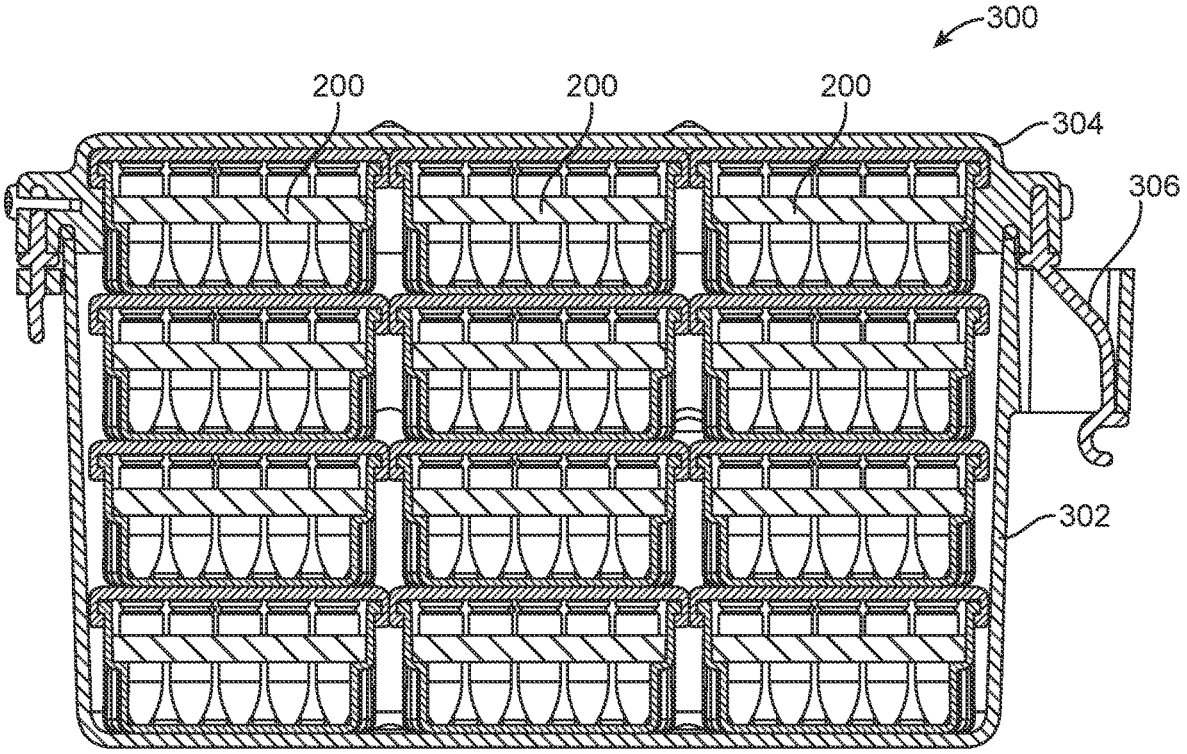

Referring to FIGS. 17A and 17B, a master storage unit 300 may be configured such that one master storage unit 300 that holds a dozen 9 mm 50 round boxes, i.e., storage units 200 may also hold nine 357 magnum 50 round boxes, i.e., storage units 200 with a greater height than that required for storing 9 mm 50 rounds. The master storage unit 300 includes a storage box 302 and a lid 304. The storage box 302 is configured to contain the storage units 200 therein. The storage units 200 may be proportioned to fit neatly together into the master storage units 300. More specifically, the master storage unit 300 and the storage units 200 may be designed to have a standard size, wherein regardless of the height of the storage units 200, which depends on the kind of ammo stored therein, they may be stacked together in the most optimal manner within the master storage unit 300. For example, referring to FIG. 17A, a schematic view of the master storage unit 300 is depicted. The master storage unit 300 has nine storage units 200 of longer ammo, e.g., 357 magnum 50 round. As seen in FIG. 17B, the same master storage unit 300 is configured to contain a dozen of storage units 200 storing therein smaller rounds, e.g., 9 mm 50 rounds.

In one or more embodiments, the master storage units 300 do not have a hinge. In one or more embodiments, the master storage units 300 include latches that are two snaps essentially. The user can press in on one or both of these latches to open the box. In one or more embodiments, one of the latches is designed to be in the center of mass for the case so that it doubles as a balanced handle 306 on the end.

The loader, in accordance with yet another embodiment may be operated in an automated manner or a semi-automated manner. In a semi-automated embodiment, a crank may be provided on the magazine loader extension to automate the processes. The crank may include a handle for allowing a user to rotate the handle, wherein the rotary motion of the crank may be converted to linear motion via a pin off center of rotation in a cam slot such that when the magazine starts in essentially the same position as the starting position for the manual loading with the pin rotation in the appropriate location. As the pin rotates and travels in a downward direction it presses the magazine down which compresses the spring with the incoming round. As the pin continues to rotate and travels across the bottom the magazine will be slid forward to push the round fully into the magazine. As the pin continues to rotate and travels up the magazine is pulled up which allows the next round to come in from the hopper. As the pin travels across the top (in the opposite direction as it did across the bottom) it moves the magazine back to get the magazine back to the starting position again. In another semi-automated embodiment, it could be a two-step process of the operator pressing on two buttons or levers one to press the magazine down or the round up, and the second to push the magazine forward or the round backward in order to finish the loading process.

In automated embodiments, a motor may be provided to turn the crank. In another fully automated embodiment multiple motors may be used. In this embodiment, a microcontroller may be configured to operate the mechanism. Variations in speed, acceleration, deceleration, distance traveled, etc. may be made to tweak the use for particular rounds, magazines, user preference, etc. In another automated embodiment, two separate linear actuators, these can be any number of designs, pneumatic, hydraulic, electric, electric motors with rack and pinion to convert rotary motion to linear motion, etc., can be used to move the magazine down and up, or the round up and down and either the magazine back and forth or the round back and forth to achieve the same magazine loading.

The ammunition magazine loader, in accordance with the various embodiments of the present subject matter, may be made of any material including, but not limited to, metallic material, wooden material, plastic material, or any other polymeric material. One exemplary criterion of selecting an appropriate manufacturing material may be the aesthetic appearance of the ammunition magazine loader. For example, a metallic material may be used to make a plain looking ammunition magazine loader, while a wooden material may be used to provide an antique like finish to the ammunition magazine loader.

An advantageous aspect of the ammunition magazine loader in accordance with different embodiments envisaged in the present subject matter is the simple design and ease of usage. A simple design ensures low manufacturing costs.

In addition, while the present invention is illustratively shown used with a straight magazine, ammunition magazine loader 100 can be configured for use with any shaped magazine, including straight, curved, etc.

While the present invention contemplates the provisioning of the various positions, shapes, and/or radii, it is merely illustrative that the invention provides a particular combination having functional utility. Further, optional and illustrative shapes, positioning, and radii of portions of the ammunition magazine loader have been described, and it is expressly set forth that such shapes, positions, and radii, are to be construed as illustrative and enabling teachings, with reasonable deviations being expressly contemplated, and are expressly to be construed as being within the spirit and scope of the present invention. Moreover, such portions, including their respective positioning, shapes, and/or radii, are provided as teachings for advantageous use with geometric dimensions of 9×19 mm Parabellum (as well as, for example, 357 SIG, 45 ACP, 10 mm, and 40 caliber rounds); however, such portions, including their respective shapes, positioning, and/or radii are to be further construed as teachings to accommodate other sized rounds. In particular, any selection, shaping, positioning, and/or radii of such portions can be determined for alternatively shaped rounds based on how the illustrative embodiments and aspects herein physically manipulate rounds. Further, tolerances of the exemplary radii described herein can be up to 0.1, 0.2, 0.3 inches or more, with due consideration to adjacent and cooperating geometries related thereto. Accordingly, the present invention is expressly contemplated to apply to various types of rounds for use with single and double feed magazines types.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure is not limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. An ammunition magazine loader comprising:

a loader body defining a pair of guide walls, a front wall, and a back wall, wherein the loader body is configured to facilitate an introduction of a magazine between the guide walls and allow a vertical linear movement of the magazine and a horizontal movement back and forth along a longitudinal axis of the loader body between the guide walls, and the guide walls configured to facilitate placement of a round to be loaded into the magazine therein and facilitate the loading of the round in the loader via the linear movement of the magazine in the loader body; and a cradle configured on an inner base of the loader body between the guide walls for holding the round therein, the cradle is configured to hold the round in a position aligned with the horizontal linear movement of the magazine to facilitate the loading of the round in the magazine;

wherein the cradle has a V-shaped profile configured to center the round being held therein;

wherein a pair of feed lip slots are configured on both sides of the locator tab and at least a portion of the length of the cradle on both sides for accommodating the pair of magazine lips therein while the loading of the round in the magazine.

2. The ammunition magazine loader according to claim 1, further comprising a hopper extending from the loader body configured to contain a plurality of rounds therein, wherein the hopper is configured to supply one round at a time in the loader body under an effect of a biasing force.

3. The ammunition magazine loader according to claim 2, wherein the hopper is a horizontal hopper extending longitudinally from the loader body, the horizontal hopper having a sloped interior for facilitating provision of biasing force in the form of gravity to the plurality of rounds for being displaced and received into the cradle.

4. The ammunition magazine loader according to claim 2, wherein the hopper is a vertical hopper extending orthogonally from the loader body, the vertical hopper having a sloped interior for facilitating guided movement of the plurality of rounds into the cradle.

5. The ammunition magazine loader according to claim 1, further comprising a locator tab configured adjacent the cradle between the guide walls, the locator tab configured for facilitating alignment of a magazine with the round to be loaded in the magazine.

6. The ammunition magazine loader as claimed in claim 1, wherein a pair of feed lip slots are configured on both sides of the locator tab and at least a portion of the length of the cradle on both sides for accommodating the pair of magazine lips therein while the loading of the round in the magazine.

7. The ammunition magazine loader as claimed in claim 5, wherein the locator tab has a height greater than that of the cradle.

8. The ammunition magazine loader as claimed in claim 5, wherein the locator tab and the cradle are configured substantially centrally on the inner base of the loader body.

9. An ammunition magazine loader comprising:

a loader body defining a pair of guide walls, a front wall, and a back wall, wherein the loader body is configured to facilitate an introduction of a magazine between the guide walls and allow a vertical linear movement of the magazine and a horizontal movement back and forth along a longitudinal axis of the loader body between the guide walls, and the guide walls configured to facilitate placement of a round to be loaded into the magazine therein and facilitate the loading of the round in the loader via the linear movement of the magazine in the loader body;

a hopper extending from the loader body configured to contain a plurality of rounds therein, wherein the hopper is configured to supply one round at a time in the loader body under an effect of a biasing force; and a cradle configured on an inner base of the loader body between the guide walls for holding the round therein, the cradle is configured to hold the round in a position aligned with the horizontal linear movement of the magazine to facilitate the loading of the round in the magazine;

wherein the cradle has a V-shaped profile configured to center the round being held therein;

wherein a pair of feed lip slots are configured on both sides of the locator tab and at least a portion of the length of the cradle on both sides for accommodating the pair of magazine lips therein while the loading of the round in the magazine.

10. The ammunition magazine loader according to claim 9, wherein the biasing force is gravity.

11. The ammunition magazine loader according to claim 10, further comprising a locator tab configured adjacent the cradle between the guide walls, the locator tab configured for facilitating alignment of a magazine with the round to be loaded in the magazine.

12. The ammunition magazine loader as claimed in claim 9, wherein a pair of feed lip slots are configured on both sides of the locator tab and at least a portion of the length of the cradle on both sides for accommodating the pair of magazine lips therein while the loading of the round in the magazine.

13. The ammunition magazine loader as claimed in claim 11, wherein the locator tab has a height greater than that of the cradle.

14. The ammunition magazine loader as claimed in claim 11, wherein the locator tab and the cradle are configured substantially centrally on the inner base.

15. The ammunition magazine loader as claimed in claim 9, wherein the hopper is a horizontal hopper extending longitudinally from the loader body, the horizontal hopper having a sloped interior for facilitating provision of biasing force in the form of gravity to the plurality of rounds for being displaced and received into the cradle.

16. The ammunition magazine loader as claimed in claim 9, wherein the hopper is a vertical hopper extending orthogonally from the loader body, the vertical hopper having a sloped interior for facilitating guided movement of the plurality of rounds into the cradle.

* * * * *